US006943324B2

(12) United States Patent
Ahuja

(10) Patent No.: US 6,943,324 B2
(45) Date of Patent: Sep. 13, 2005

(54) COMBINATION HEATING SYSTEM FOR A COOKING APPLIANCE

(75) Inventor: Sandeep Ahuja, Richmond, VA (US)

(73) Assignee: Maytag Corporation, Newton, IA (US)

( * ) Notice: Subject to any disclaimer, the term of this patent is extended or adjusted under 35 U.S.C. 154(b) by 67 days.

(21) Appl. No.: 10/410,286

(22) Filed: Apr. 10, 2003

(65) Prior Publication Data

US 2004/0200825 A1 Oct. 14, 2004

(51) Int. Cl.[7] ..... H05B 3/68
(52) U.S. Cl. ..... 219/446.1; 219/483; 219/486
(58) Field of Search ..... 219/446.1, 449.1, 219/483, 486, 494, 391, 395, 400; 126/273 R, 275 E, 273 A

(56) References Cited

U.S. PATENT DOCUMENTS

| | | | |
|---|---|---|---|
| 1,457,608 | A | 11/1923 | Templeton |
| 1,495,685 | A | 5/1924 | Graf |
| 1,815,088 | A | 7/1931 | Allen et al. |
| 2,222,065 | A | 11/1940 | Blakeslee |
| 2,463,712 | A | 3/1949 | Newell |
| 3,423,568 | A | 1/1969 | Meckley III, et al. |
| 4,926,837 | A | 5/1990 | Parker et al. |
| 5,193,522 | A | 3/1993 | Damsteegt et al. |
| 5,275,147 | A | 1/1994 | Atkinson, III |
| 5,909,533 | A | 6/1999 | Kitabayashi et al. |
| 6,222,163 | B1 | 4/2001 | Arntz et al. |
| 6,388,235 | B1 * | 5/2002 | Sauter et al. ..... 219/400 |

* cited by examiner

*Primary Examiner*—Sang Paik
(74) *Attorney, Agent, or Firm*—Diederiks & Whitelaw, PLC; Allan P. Orsund

(57) ABSTRACT

A cooking appliance includes a gas burner element, at least one electric heating element and a convection airflow system having a convection fan about which is disposed the at least one electric heating element. A control unit selectively activates the gas burner, the electric heating element and the convection fan to establish a desired temperature within the oven cavity. Once established, the control unit then cycles operation of the gas burner and electric heating element to maintain the desired temperature. With this arrangement, in a start-up period during which products of combustion are highest, operation of the electric heating element aides in the combustion process to reduce emissions from the appliance, as well as causing a reduction in overall cook time.

11 Claims, 2 Drawing Sheets

COMBINATION HEATING SYSTEM FOR A COOKING APPLIANCE

BACKGROUND OF THE INVENTION

1. Field of the Invention

The present invention pertains to the art of cooking appliances and, more particularly, to a gas cooking appliance including both electric and convection heating systems.

2. Discussion of the Prior Art

In general, hybrid ovens are well known in the art. A standard oven includes an oven cavity having a volume of 4.0 cu. ft. The hybrid oven includes at least two heating systems, for example gas and electric heating systems, which are adapted to provide heat to the oven cavity in order to perform a cooking process. There also exist several examples of appliances which, in addition to the above, include convection fan systems for generating a heated airflow that contributes to cooking performance. Typically, the electric heating system is utilized during select cooking operations, namely, broiling. For example, U.S. Pat. No. 2,463,712 discloses a hybrid cooking appliance incorporating an electric heating element which is particularly used for broiling purposes. However, the electric heating element can also be used during a baking operation when the oven cavity requires heating above a predetermined temperature level. In this arrangement, once the oven has reached the required temperature level, a thermostat functions to automatically cut-off the electric heating element, and the oven temperature is thereafter maintained solely through operation of the gas heating system.

In another exemplary arrangement, as disclosed in U.S. Pat. No. 4,926,837, a coiled electric heating element, or booster element, is positioned about a convection fan and operated in combination with a gas burner. As described, operation of the booster element is primarily used to shorten the initial warm-up time of the oven. Once the oven reaches a predetermined temperature, the booster element is de-energized, and a microwave heating system is energized, such that the overall cooking operation is conducted by a combination of gas and microwave heating systems. While each of these arrangements is effective at heating standard size ovens, e.g., a 4.0 cu. ft. oven cavity, when the size of the oven cavity is enlarged to, for example, 5.2 cu. ft., it becomes increasingly difficult to maintain a constant, uniform temperature in the oven cavity.

Therefore, regardless of these arrangements, there still exists a need in the art for a combination heating system for a cooking appliance having an enlarged oven cavity. Specifically, a combination gas and electric heating system in which the electric heating system is cycled in combination with the gas heating system in order to efficiently maintain a uniform, predetermined oven temperature. More specifically, there exists a need for a cooking appliance including an electric heating element which is located about a periphery of the convection fan system and operates in unison with the gas burner. The combined operation aides in the combustion of gas in order to maintain combustion byproducts within accepted agency standards.

SUMMARY OF THE INVENTION

The present invention is directed to a cooking appliance including an enlarged oven cavity, a convection airflow system, an electric heating system, a gas heating system, and a control unit. More specifically, the control unit is operatively connected to each of the convection airflow system, electric heating system and gas heating system such that, upon selection of a cooking operation, the control unit selectively activates each of the above systems to establish a particular oven cavity temperature.

In one form of the present invention, the electric heating system includes an electric heating element arranged about a periphery of the convection airflow system. With this arrangement, un-combusted gas byproducts developed through operation of the gas heating system due to insufficient heat are exposed to a secondary heat source. The secondary heat source exposes the products of combustion to a second heating process which further combusts the byproducts and minimizes the amount of carbon monoxide (CO) and other gases exhausted from the appliance. In addition to reducing the products of combustion, operating the electric and gas heating system in unison reduces the overall time required to pre-heat the appliance.

In accordance with the most preferred form of the invention, the control unit regulates the operation of the electric and gas components once the desired temperature is achieved. More particularly, the control unit cycles operation of the gas burner in unison with operation of the electric heating element. In this manner, the control unit establishes a more even heat distribution within the enlarged oven cavity and reduces the time required to perform a cooking operation.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
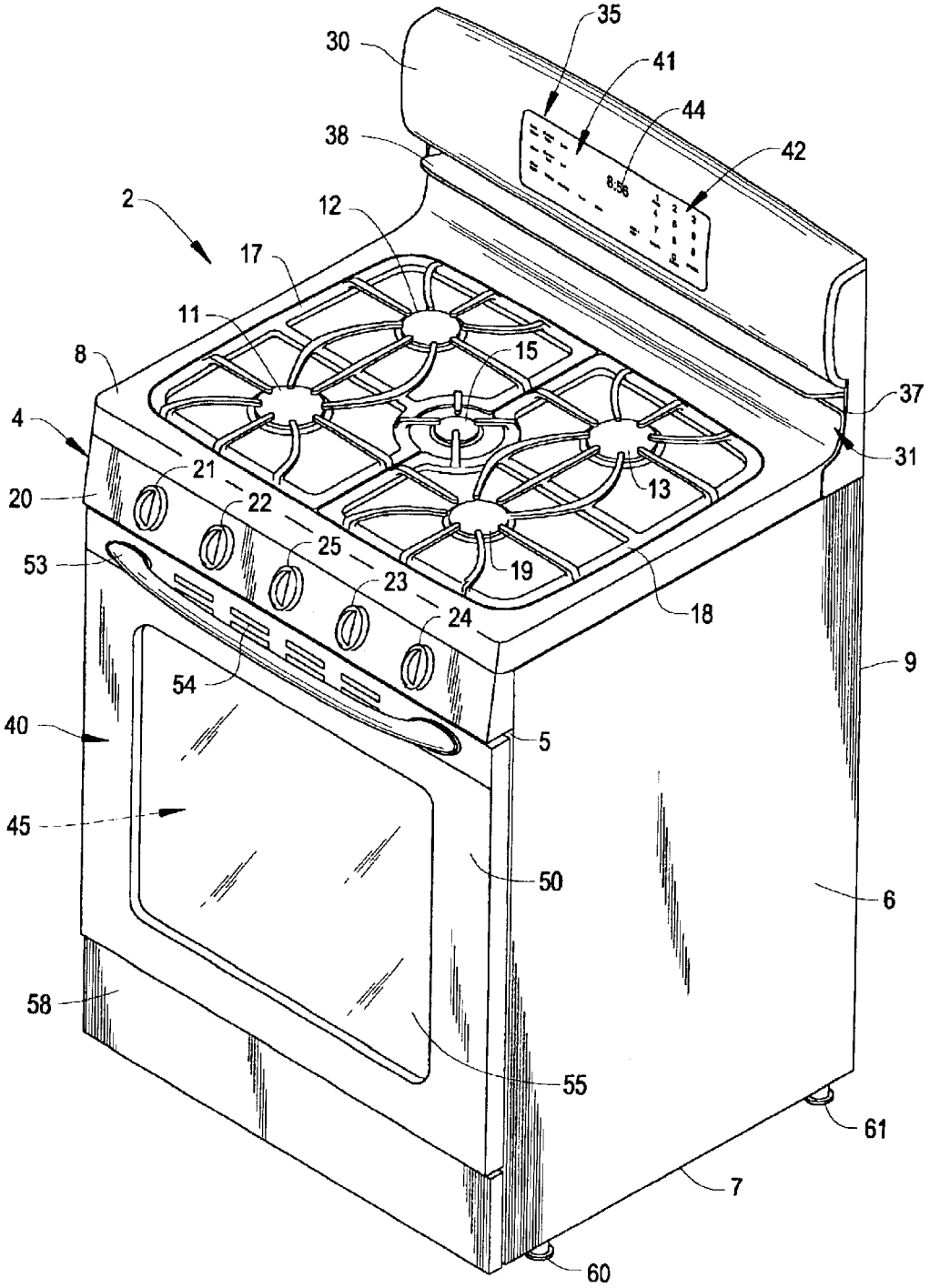
FIG. 1 is an upper right front perspective view of a cooking appliance incorporating a combination heating system constructed in accordance with a preferred embodiment of the present invention.

With initial reference to FIG. 1, the present invention is preferably incorporated into a cooking appliance generally indicated at 2. As shown, cooking appliance 2 takes the form of a free-standing gas range. Range 2 includes a cabinet 4 having a front panel portion 5, opposing side panel portions 6, a bottom portion 7, a range top 8, and a main back panel 9. Within the scope of the invention, range top 8 can take on various forms. In the preferred embodiment shown, range top 8 is provided with five gas burner elements 11–15, i.e., four outer quadrant gas burner elements 11–14 and a central gas burner element 15, which are covered by left and right, mirror image burner grates 17 and 18.

In the embodiment illustrated, cabinet 4 further includes a front control surface 20. Preferably, control surface 20 supports a plurality of control knobs 21–25 for controlling the activation/de-activation of gas burners 11–15 respectively. Furthermore, cabinet 4 includes an upstanding control panel 30 arranged at an upper rear portion 31 of cabinet 4. In the embodiment shown, control panel 30 is provided above an exhaust outlet opening 37 extending across upper rear portion 31 and having an associated exhaust deflector 38 for directing an exhaust airflow away from control panel 30. Further illustrated in FIG. 1, control panel 30 includes a central control and display unit, generally indicated at 35, for use in controlling an oven 40 of range 2. Although not fully detailed in this figure, control and display unit 35 includes a first control section 41 for selecting a desired cooking operation for oven 40. For instance, a user can select between keep warm, convection bake, bake, clean convection broil, broil, drying, and bread proofing operations. In connection with setting desired cooking parameters, control and display unit 35 also includes a second control section 42 which defines a numeric key pad. At this point, it should be realized that the arrangement and features associated with control panel 30 can vary without departing from the invention. For instance, in addition to other standard controls, such as timer and clock setting elements, control panel 30 can provide for other operations, such as a "cook and hold" feature wherein oven 40 operates to maintain food cooked therein warm following a cooking operation or a "favorite" selector which can be employed to readily establish a predetermined, preferred cooking sequence for oven 40. In any event, control and display unit 35 further includes a central display 44 for conveying information to and verifying input/operational parameters to a user.

In the preferred embodiment, oven 40 includes an oven cavity 45 which is larger than an oven cavity provided in a standard oven range. More specifically, wherein the volume of a standard oven cavity for a range would be in the order of 4.0 cubic feet, oven cavity 45 is approximately 5.2 cubic feet. In accordance with the present invention, oven cavity 45 is preferably formed of metal and coated with a heat resistant material, such as porcelain. In any case, oven 40 has associated therewith a door 50 which can be pivoted by means of a handle 53. Door 50 preferably includes a plurality of vents arranged behind handle 53 and a window 55 for viewing the contents of oven cavity 45 when door 50 is closed. Arranged below door 50 and extending across cabinet 4 is a lower face panel 58.

In a manner known in the art, range 2 is adapted to be mounted upon a supporting surface, such as a kitchen floor or the like. More specifically, a plurality of leg members, two of which are indicated in FIGS. 1 at 60 and 61, extend from bottom portion 7 at front and rear portions of cabinet 4, along side panel 6. Of course, corresponding leg members 60 and 61 are also provided on the opposing side of range 2. In any event, the various leg members 60 and 61 are preferably vertically adjustable to also act as levelers for range 2. Such type of leg leveler arrangements are widely known in the art of appliances, including both ranges and refrigerators such that the leveling function of leg members 60 and 61 does not form part of the present invention.

Figure 2:
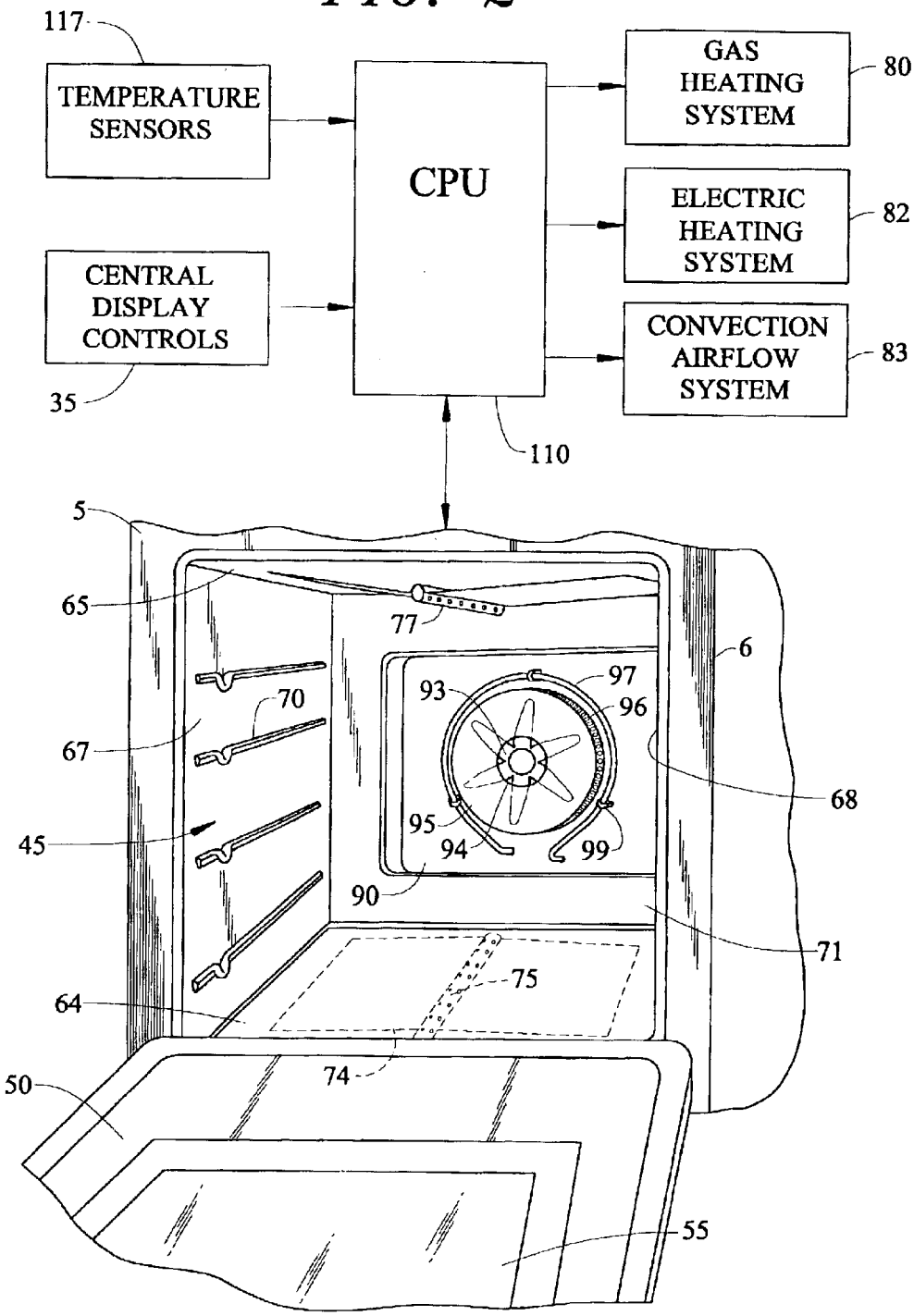
FIG. 2 is a partial front perspective view of an oven cavity of the cooking appliance of FIG. 1 incorporating the combination heating system arranged in accordance with the present invention.

As best seen in FIG. 2, oven cavity 45 is defined by a bottom wall 64, an upper wall 65, opposing side walls 67 and 68 provided with a plurality of vertically spaced fore-to-aft extending side rails one of which is indicated at 70, and a rear wall 71. In the embodiment shown, bottom wall 27 is constituted by a flat, smooth surface designed to improve the cleanability of oven cavity 45. Arranged below bottom wall 64 of oven cavity 45 is a burner box (not shown) provided with a gas burner baffle 74 and a gas burner 75. Actually, bottom wall 64 is removable so as to provide access to gas burner 75. Gas burner 75 is provided to perform a baking operation in oven cavity 45. Also, an upper gas burner 77 is arranged along upper wall 65 of oven cavity 45. Upper gas burner 77 is provided to enable a consumer to perform a grilling process in oven 40 and to aid in pyrolytic heating during a self clean operation. More specifically, both lower gas burner 75 and upper gas burner 77 constitute a gas heating system for cooking appliance 2.

In addition to gas heating system 80, oven cavity 45 is provided with an electric heat system 82 and a convection airflow system 83 to provide both radiant and convection heating techniques for cooking food items therein. In accordance with the most preferred embodiment of the invention, electric heat system 82 and convection airflow system 83 operates on approximately 110 Volts, thereby enabling cooking appliance 2 to be readily connected to a standard wall outlet. To this end, rear wall 71 is shown to include a recessed portion or convection air plenum 90 within which is arranged a convection fan or blower 93 having an associated central inlet or intake zone 94 arranged about a vented cover 95, and an outlet 96. Although the exact position and construction of fan 93 can readily vary in accordance with the invention, in accordance with one preferred form, fan 93 draws in air at a central intake zone 94 of vented cover 95 and directs the air into oven cavity 6 in a radial outward direction through outlets 96. Also, as clearly shown in this figure, a sheathed electric heating element 97, which preferably takes the form of a ring, extends circumferentially about fan 93 and is mounted through by a plurality of support members, one of which is indicated at 99. More specifically, electric heating element 97, which forms part of electric heating system 82, is provided to heat the radially directed air flow from convection fan 93.

The above structure has been mainly described for the sake of completeness. The present invention is particularly directed to the benefits of combining the operation of gas heating system 80 and electric heating system 82, as well as the operation of convection airflow system 83, to maintain a substantially uniform cooking temperature within oven cavity 45.

In accordance with the most preferred form of the present invention, cooking appliance 2 includes a controller or CPU 110 which is adapted to receive inputs from central control and display unit 35, as well as a plurality of temperature sensors 117 arranged about oven cavity 45. Based on the controlled inputs and sensed temperatures, CPU 110 maintains a uniform temperature within oven cavity 45 by a combined operation of gas heating system 80 and electric heating system 82, as well as the operation of convection airflow system 83, in a manner as will be described more fully below.

During an initial start up or preheat phase, controller 110 simultaneously activates gas heating system 80, electric heating system 82 and, depending upon the selected cooking operation, convection airflow system 83. The activation of electric heating system 80, which operates in the capacity of a second or supplementary heat source, increases the internal temperature of oven cavity 45 at a fairly rapid rate which, in addition to lowering an overall preheat time for oven cavity 45, advantageously minimizes the amount of byproducts generated by the operation of gas heating system 80. Specifically, the operation of electric heating system 82 provides a heating boost during the preheat period at which time combustion byproducts, generated by gas heating system 80, are present at high levels. The incorporation of the secondary heat source, which is capable of rapidly achieving radiant temperatures, improves the overall combustion of oven gases and thereby minimizes combustion byproducts, such as carbon monoxide. With this operational arrangement, emissions from cooking appliance 2 are maintained well below levels established by government agencies and other standard setting organizations.

In addition to reducing products of combustion, the present invention also reduces overall cook time for many food items by more than 25% (See Table 1). The reduction in cooking time is, at least partially, attributed to the increase in the convective heat transfer from the hot oven gases to food items placed within oven cavity 45. Convection airflow system 83 increases the overall movement of hot oven gases within oven cavity 45 by establishing an constant air flow during a convection cooking operation which as discussed previously, draws oven gases in through inlet 94 of cover 95 and thereafter redirects the oven gases radially outwardly through outlets 96 back into oven cavity 45. This air flow, established within oven cavity 45, increases the heat transfer rate to the food items contained therein. Furthermore, the combined operation of the two heat sources, i.e., electric and gas heat, in conjunction with operation of convection airflow system 83, produces a more even heat distribution within oven cavity 45. In further accordance with this most preferred form of the invention, the heat distribution created within oven cavity 45 is established by continued operation of the convection airflow system 83, while the operation of each of electric heating system 82 and gas heating system 80 is cycled in unison.

TABLE 1

Cooking test data showing reduction in cook time

| Food Item | Cooking Temperature | Normal Bake Time | Actual Bake Time | Time Saved (%) |
|---|---|---|---|---|
| Cake | 350° F. | 39 min | 28 min | 28 |
| Cookies | 350° F. | 18 min | 11 min | 39 |
| Pizza | 400° F. | 23 min | 15 min | 35 |
| Lasagna | 375° F. | 49 min | 36 min | 27 |
| Cinnamon Rolls | 350° F. | 16 min | 10 min | 38 |
| Turkey | 325° F. | 7 hr, 45 min | 5 hr, 18 min | 32 |
| Green Bean Casserole | 350° F. | 65 min | 50 min | 23 |
| Lemon-Poppy Seed Bread | 375° F. | 45 min | 34 min | 24 |

During a typical baking operation, oven cavity 45 can reach a temperature which would warrant ceasing operation of all heat sources, or at least greatly reducing the capacity thereof. In the most preferred form of the invention, controller 60 functions to deactivate gas heating system 80 and electric heating system 82, while maintaining continued operation of convection airflow system 83. When the selected temperature within oven cavity 45 falls below a predetermined limit, controller 110 re-activates, or cycles operation of gas heating system 80 and electric heating system 82 in unison. Cycling the gas and electric heating systems 80 and 82 in this fashion has been found to enhance not only the overall cooking of the food items, but also advantageously performs a browning function.

Although described with reference to a preferred embodiment of the invention, it should be readily apparent that various changes and/or modifications can be made to the invention without departing from the spirit thereof. For instance, the particular mounting arrangement of each of the heating systems could be varied without departing from the scope of the present invention. Furthermore, incorporating a microwave heating system into the appliance is also contemplated as an acceptable option. In general, the invention is only intended to be limited by the scope of the following claims.

I claim:

1. A cooking appliance capable of performing baking operations comprising:

a cabinet;

an oven cavity arranged within the cabinet, said oven including top, bottom, rear and opposing side portions;

a gas burner element positioned to radiate heat into the oven cavity;

a convection airflow system including a convection fan adapted to circulate a convection airflow within the oven cavity;

an electric heating system including an electric heating element disposed adjacent to the convection fan so as to be exposed to the convection airflow; and a control unit operatively connected to each of the gas burner element, the electric heating element and the convection airflow system wherein, upon selection of a baking operation for the cooking appliance, the control unit activates each of the gas burner element, the electric heating element and the convection airflow system to establish a substantially constant oven cavity temperature, said control unit further operating to cycle the operation of the gas burner element and the electric heating element in combination at least following a preheat stage of the baking operation so as to be concurrently activated and deactivated in order to maintain the substantially constant oven cavity temperature for a desired time period.

2. The cooking appliance according to claim 1, wherein the control unit continuously operates the convection airflow system while the gas burner element and the at least one electric heating element are cycled.

3. The cooking appliance according to claim 2, wherein the convection fan is mounted along a rear wall portion of the oven cavity.

4. The cooking appliance according to claim 3, wherein the at least one electric heating element extends about a periphery of the convection fan.

5. The cooking appliance according to claim 1, wherein the electric heating element constitutes a sheathed, resistive electric heating element.

6. The cooking appliance according to claim 1, wherein the oven cavity is in the order to 5.2 cubic feet.

7. The cooking appliance according to claim 1, wherein both the convection airflow system and the electric heating system operate on approximately 110 Volts.

8. A method of performing a baking operation in a cooking appliance including a gas burner element, a convection airflow system having a convection fan, and at least one electric heating element positioned adjacent to the convection fan comprising:

selecting a desired oven temperature for the baking operation;

activating each of the gas burner element, the convection fan and the at least one electric heating element;

operating each of the gas burner element, the convection fan and the at least one electric heating element until the desired oven temperature is reached; and cycling the activation of the gas burner element and the at least one electric heating element in unison, at least following a preheat stage of the baking operation, so as to be concurrently activated and deactivated such that the oven cavity temperature is maintained substantially constant for a select period.

9. The method of claim 8, further comprising: continuously operating the convection fan while the gas burner element and the at least one electric heating element are cycled.

10. The method of claim 8, further comprising:

mounting the at least one electric heating element about a periphery of the convection fan; and directing a convection airflow past the at least one electric heating element and into the oven cavity.

11. The method of claim 8, wherein both the convection fan and the at least one electric heating element are operated at approximately 110 Volts.

* * * * *